United States Patent [19]

Fukushima et al.

[11] Patent Number: 4,642,136

[45] Date of Patent: Feb. 10, 1987

[54] PTC CERAMIC COMPOSITION

[75] Inventors: Noburu Fukushima, Tokyo; Hisashi Yoshino; Shunji Nomura, both of Yokohama, all of Japan

[73] Assignee: Kabushiki Kaisha Toshiba, Kawasaki, Japan

[21] Appl. No.: 699,302

[22] Filed: Feb. 7, 1985

[30] Foreign Application Priority Data

Jun. 11, 1984 [JP] Japan ..... 59-118207

[51] Int. Cl.[4] ..... C22C 29/12

[52] U.S. Cl. ..... 75/234; 252/512; 252/518; 338/22 R

[58] Field of Search ..... 338/22 R; 252/512, 518; 75/234, 232, 252

[56] References Cited

U.S. PATENT DOCUMENTS 4,483,933 11/1984 Kobayashi et al. ..... 501/138

OTHER PUBLICATIONS

W. Heywang, "Semiconducting Barium Titanate", Journal of Materials Science 6, (1971), pp. 1214–1226.

Ruegg, et al, "Processing of a Ceramic PTC Resistor Based on $V_2O_3$", Science of Ceramics, vol. 11, 1981, pp. 559–564.

R. S. Perkins, et al, "A New PTC Resistor for Power Applications", IEEE Transactions on Components, Hybrids and Manufacturing Technology, vol. 5, No. 2, Jun. 1982, pp. 225–230.

*Primary Examiner*—Stephen J. Lechert, Jr.
*Assistant Examiner*—Anne Brookes
*Attorney, Agent, or Firm*—Schwartz, Jeffery, Schwaab, Mack, Blumenthal & Evans

[57] ABSTRACT

A PTC ceramic composition comprising a fundamental component represented by the formula:

$$(V_{1-x}A_x)_2O_3$$

wherein x is a value within the range of $0 \leqq x \leqq 0.02$ and A is at least one of Cr and Al, and tin in an amount of 1 to 25 % by weight based on the total weight of the composition, has a small electric resistance in the low resistance state, good PTC properties, and a high density.

7 Claims, 2 Drawing Figures

PTC CERAMIC COMPOSITION

BACKGROUND OF THE INVENTION

This invention relates to a ceramic composition for a PTC (positive temperature coefficient) resistor and, more specifically to a ceramic composition for a PTC resistor which is characterized by having a small specific resistance in the state of a low resistance.

Heretofore, as typical materials for the PTC resistor, there have been used $BaTiO_3$ ceramics in which a variety of impurities are included. For example, $BaTiO_3$ ceramics in which La, Sm, Sb or Nb is included shows PTC properties in that the relative resistance thereof increases about $10^4$ times at around 250° C. as compared with those of at ambient temperature (J. Mat. Sci., Vol. 6, p. 1214 (1971); W. Heywang). These ceramics have as large an electric resistance at $10^0$ Ωcm or more in a low resistance condition and their PTC phenomenon depends on a mechanism which is based on grain boundary layers; therefore they can scarcely be utilized in fields utilizing a large electric power.

It is known that the compound $V_2O_3$ in which Cr or Al is included has PTC properties of a specific resistance based on the fact that it transfers from a metallic state to an insulating state at from room temperature to about 200° C. For example, a $V_2O_3$ single crystal in which Cr is included, shows PTC properties in that the relative resistance thereof increases from $10^{-2}$ Ωcm to 1 Ωcm with increasing temperature at around room temperature (Phys. Rev. B7, p. 1920 (1973); D. B. McWhan et al.). In a $V_2O_3$ single crystal in which Al is included, the same PTC properties as mentioned above have been observed (Phase Transitions, 1, P. 289 (1980); H. Kuwamoto & J. M. Honig). However, it is hard to prepare these materials in the form of a large single crystal. Further, their polycrystal sinters are poor in sintering characteristics, accordingly high-density ceramics are difficult to obtain from them. Futhermore, the specific resistance of the PTC properties in the low resistance state is about 10 times as high as that of the single crystal; therefore it is hard to obtain a high PTC magnification. In addition, by since being low in strength owing to their low density, such polycrystal sinters cannot be applied to fields utilizing a large electric power.

SUMMARY OF THE INVENTION

This invention has been provided in view of the abovementioned problems, and its object is to provide a ceramic composition for a PTC resistor which mainly comprises $V_2O_3$ and which is improved in sintering characteristics and PTC properties.

The composition of this invention comprises a fundamental component represented by the formula:

$$(V_{1-x}A_x)_2O_3$$

wherein x is a value within the range of $0 \leqq x \leqq 0.02$ and A is at least one of Cr and Al, and tin in an amount of 1 to 25% by weight based on the total weight of the composition.

DESCRIPTION OF THE PREFERRED EMBODIMENTS

Figure 1:
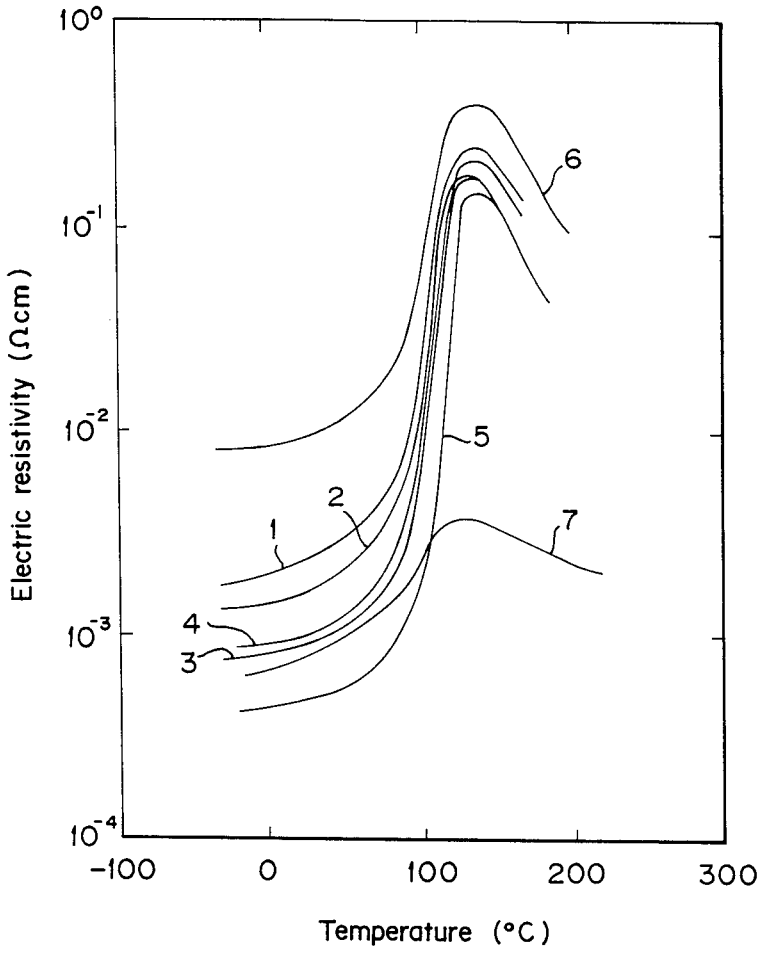
FIG. 1 is a diagram showing the influence of temperatures on electric resistivities of samples in Example 1.

In the following, this invention will be further described in detail.

This invention is directed to a ceramic composition for a PTC resistor which comprises a component represented by the formula:

$$(V_{1-x}A_x)_2O_3$$

wherein x is a value within the range of $0 \leqq x \leqq 0.02$ and A is at least one of Cr and Al, and tin in an amount of 1 to 25% by weight based on the weight of the fundamental component. That is, in this invention, tin (Sn) is added to the component $(V_{1-x}A_x)_2O_3$ to prepare the ceramic composition having a heightened sintering characteristics and improved PTC properties. Sn is stable as a metal at a sintering temperature of 1400° to 1600° C. and in a sintering atmosphere, and serves to accelerate sintering when interposed among the grains of the compound $(V_{1-x}A_x)_2O_3$. The sintered composition which has undergone a sintering treatment includes an Sn deposition phase therein by which a specific resistance among the PTC properties is decreased in a low resistance region, lowered and an current capacity is increased.

The reason why the respective components in the composition of this invention are quantitatively restricted to the above-mentioned range is as follows: The amount x of the component A has a directed influence on the PTC properties, when being in the range of $0 \leqq x \leqq 0.020$. Particularly, it is preferred that the factor x is in the range of $0.001 \leqq x \leqq 0.020$.

As mentioned above, the component A comprises Cr and/or Al, and when both of them are used, a ratio of one to another can be suitably decided, so long as the total amount of them is within the range of the abovementioned amount x.

A ratio of Sn to the fundamental component $(C_{1-x}A_x)_2O_3$ is within the range of 1 to 25% by weight, preferably 2.0 to 20.0% by weight. When the amount of the added Sn is less than 1% by weight, the effect of improving the sintering characteristics will not be obtained; when it is more than 25% by weight, a maximum value of the specific resistance of the PTC properties will be remarkably lowered and the magnification of a variation in the specific resistance will also be disadvantageously reduced.

A PTC element in which the ceramic composition of this invention is employed can be prepared as follows:

Usable materials for the ceramic composition include powdery metallic oxides such as $V_2O_5$, $V_2O_3$, $Cr_2O_3$, $Al_2O_3$ and $SnO_2$. The employment of $V_2O_3$ as the vanadium oxide starting material is preferable since it can abbreviate a reduction procedure of the vanadium oxide whereby a particle growth or the aggregation of the particles at the reduction procedure from $V_2O_5$ to $V_2O_3$ are prevented.

The powders of $V_2O_5$ or $V_2O_3$, $Cr_2O_3$, $Al_2O_3$ and $SnO_2$ are weighed, and they are then mixed and ground in, for example, a wet ball mill, followed by reducing. When $V_2O_5$ is used, it is reduced to $V_2O_3$. The employment of the powder mainly comprising the produced $V_2O_3$ permits effectively improving the uniformity of the ceramic composition. Adding tin to the fundamental component in the form of $SnO_2$ and mixing them also allows the uniformity of the fundamental composition to be improved. Then, most of the added $SnO_2$ is reduced to metallic tin. To the resulting powder, an organic binder such as a paraffin or a polyvinyl alcohol (PVA) is added, and pressure molding is then carried out. Afterward, the molded material is sintered in a reducing atmosphere such as a hydrogen stream.

The ceramic element thus obtained which has densely been sintered, is considered excellent because of having a low specific resistance value in a low resistance condition.

From the foregoing it is apparent that, the selection of the composition regarding this invention permits the preparing of the $V_2O_3$-based ceramics for a PTC resistor which have a small electric resistance in the low resistance state, good PTC properties, and a high density.

The present invention will be described with reference to examples.

EXAMPLE 1

Commercially available $V_2O_5$, $Cr_2O_3$, $Al_2O_3$ and $SnO_2$ powders were prepared and the respective components were weighed for samples (Nos. 1 to 5) regarding this invention in compositive proportions shown in Table 1. They were then mixed and ground for 45 hours in a wet ball mill. Afterward, reduction was carried out at 600° C. for 2 hours and subsequently at 1000° C. for 3 hours in a hydrogen stream. To the resulting powder, a paraffin dissolved in trichloroethylene was added as an organic binder, and pressure molding was then carried out. Next, the molded materials were sintered at 1400° C. for 4 hours in the hydrogen stream to prepare the samples.

Their electrical resistivities were measured by the use of an impedance meter made by HP Inc. and the results are shown in FIG. 1. Further, as shown in Table 1, a comparative sample (No. 6) including no Sn and another comparative sample (No. 7) including an excessive amount of Sn were prepared and a similar measurement was carried out for them.

TABLE 1

| Sample No. | Composition formula | Density | Density/ Theoretical density |
|---|---|---|---|
| | This invention: | | |
| 1 | $(V_{0.9960}Cr_{0.0040})_2O_3$ + 1.0 wt % Sn | 4.59 | 94.0% |
| 2 | $(V_{0.9960}Cr_{0.0040})_2O_3$ + 2.5 wt % Sn | 4.67 | 95.0% |
| 3 | $(V_{0.9960}Cr_{0.0040})_2O_3$ + 10.0 wt % Sn | 4.86 | 96.5% |
| 4 | $(V_{0.9960}Al_{0.0040})_2O_3$ + 10.0 wt % Sn | 4.89 | 97.1% |
| 5 | $(V_{0.9960}Cr_{0.0040})_2O_3$ + 20.0 wt % Sn | 5.11 | 98.0% |
| | For comparison: | | |
| 6 | $(V_{0.9960}Cr_{0.0040})_2O_3$ | 3.55 | 72.9% |
| 7 | $(V_{0.9960}Cr_{0.0040})_2O_3$ + 30.0 wt % Sn | 5.33 | 98.5% |

The results in Table 1 indicate that the addition of Sn permits the sinter having a heightened density to be prepared.

Further, as understood from FIG. 1, in the cases of the examples regarding this invention, specific resistances in a low resistance condition decrease remarkably owing to the enhancement of the density, with the result that a great PTC magnification is obtained. On the contrary, in case of Sample 6, since the density is low, the specific resistance in the low resistance condition is large and the PTC magnification is small. Moreover, in the case of sample 7, it is definite that the excessive addition of Sn leads to the drop of a maximum specific resistance value and thus the reduction in the PTC magnification.

EXAMPLE 2

Commercially available $V_2O_3$, $Cr_2O_3$, $Al_2O_3$ and $SnO_2$ powders were prepared and the respective components were weighed for samples (Nos. 8 to 12) regarding this invention in compositive proportions shown in Table 2. They were then mixed and ground for 12 hours in a wet ball mill. To the resulting powder, a paraffin dissolved in trichloroethylene was added as an organic binder, and thye were dried. Next, the pressure molded materials were sintered at 1400° C. for 4 hours in the hydrogen stream to prepare the samples.

Figure 2:
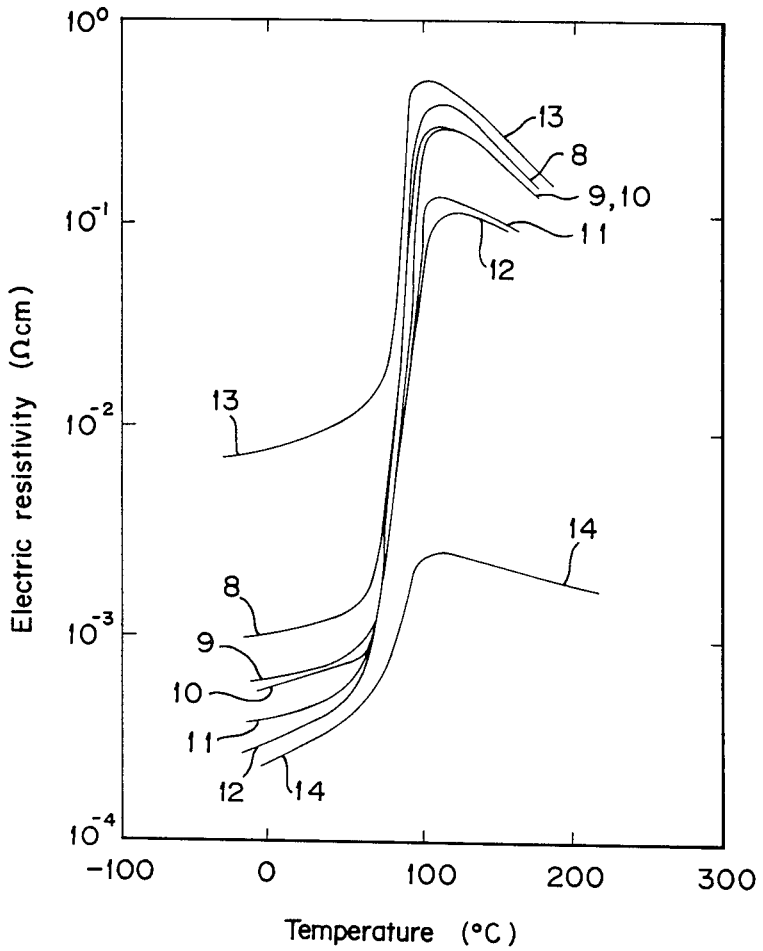
FIG. 2 is a diagram showing the influence of temperatures on electric resistivities of sample in Example 2.

Their electrical resistivities were measured in the same manner as in Example 1 and the results are shown in FIG. 2. Further, as shown in Table 2, a comparative sample (No. 13) including no Sn and another comparative sample (No. 14) including an excessive amount of Sn were prepared and a similar measurement was carried out for them.

TABLE 2

| Sample No. | Composition formula | Density | Density/ Theoretical density |
|---|---|---|---|
| | This invention: | | |
| 8 | $(V_{0.9955}Cr_{0.0025}Al_{0.0020})_2O_3$ + 1.0 wt % Sn | 4.749 | 97.2% |
| 9 | $(V_{0.9955}Cr_{0.0025}Al_{0.0020})_2O_3$ + 5.0 wt % Sn | 4.873 | 98.4% |
| 10 | $(V_{0.9955}Cr_{0.0010}Al_{0.0035})_2O_3$ + 5.0 wt % Sn | 4.878 | 98.5% |
| 11 | $(V_{0.9955}Cr_{0.0025}Al_{0.0010})_2O_3$ + 10.0 wt % Sn | 5.028 | 99.8% |
| 12 | $(V_{0.9955}Cr_{0.0025}Al_{0.0010})_2O_3$ + 20.0 wt % Sn | 5.202 | 99.7% |
| | For comparison: | | |
| 13 | $(V_{0.9955}Cr_{0.0025}Al_{0.0010})_2O_3$ | 3.872 | 79.5% |
| 14 | $(V_{0.9955}Cr_{0.0025}Al_{0.0010})_2O_3$ + 30.0 wt % Sn | 5.394 | 99.7% |

The results in Table 2 indicate that the addition of Sn permits the sinter having a heightened density to be prepared. Moreover, it is confirmed that the density of the sintered bodies are heightened more effectively as compared with the samples which were employed $V_2O_5$ as the starting materials in Example 1.

Further, as understood from FIG. 2, in the cases of the examples regarding this invention, a low specific resistances at room temperature and a great PTC magnification can be obtained. On the contrary, in case of Sample 13, the specific resistance in the low resistance condition is large and the PTC magnification is small. Moreover, in the case of sample 14, it is definite that the excessive addition of Sn leads to the drop of a maximum specific resistance value and thus the reduction in the PTC magnification.

We claim:

1. A PTC ceramic composition which comprises (i) a fundamental component represented by the formula:

$$(_{1-x}A)_2O_3$$

wherein x denotes an atomic proportion and has a value within the range of $0.001 \leqq x \leqq 0.02$, and A is at least one of Cr and Al, and (ii) tin in an amount of 1 to 25 % by weight, based on the total weight of the composition.

2. The PTC ceramic composition according to claim 1, wherein said component tin is included in an amount of 2.0 20.0 % by weight based on the total weight of the composition.

3. The PTC ceramic composition according to claim 1, wherein said fundamental component is represented by the formula:

$$(V_{1-x}Cr_x)_2O_3$$

wherein x is as defined in claim 1.

4. The PTC ceramic composition according to claim 1, wherein said fundamental component is represented by the formula:

$$(V_{1-x}Al_x)_2O_3$$

wherein x is as defined in claim 1.

5. The PTC ceramic composition according to claim 1 wherein said tin is obtained from oxide starting material used to produce said ceramic composition.

6. The PTC ceramic composition according to claim 1 wherein said vanadium and at least one of chromium and aluminum are obtained, respectively, from oxide starting material used to produce said ceramic composition.

7. The PTC ceramic composition according to claim 1 wherein said tin consists essentially of metallic tin interposed among grains of said fundamental component.

* * * * *